US007735435B2

(12) United States Patent
Eriksson et al.

(10) Patent No.: US 7,735,435 B2
(45) Date of Patent: Jun. 15, 2010

(54) APPARATUS FOR CLEANING A SMELT SPOUT OF A COMBUSTION DEVICE

(75) Inventors: Lars Eriksson, Skutskär (SE); Leif Bergmyren, Hägersten (SE)

(73) Assignee: Diamond Power International, Inc., Lancaster, OH (US)

( * ) Notice: Subject to any disclaimer, the term of this patent is extended or adjusted under 35 U.S.C. 154(b) by 556 days.

(21) Appl. No.: 11/439,674

(22) Filed: May 24, 2006

(65) Prior Publication Data

US 2007/0272130 A1 Nov. 29, 2007

(51) Int. Cl.
*F23G 7/04* (2006.01)
*B08B 1/00* (2006.01)

(52) U.S. Cl. ..... 110/259; 110/349; 15/246; 202/241

(58) Field of Classification Search ..... 110/182.5, 110/238, 348; 122/135, 379, 6.5; 134/6; 202/241; 15/246, 104.03, 104.18, 104.16; 166/173; 266/135
See application file for complete search history.

(56) References Cited

U.S. PATENT DOCUMENTS 2,391,443 A 12/1945 Bruton
2,535,932 A 12/1950 Kemock
3,025,548 A 3/1962 Berkenstein
3,607,117 A 9/1971 Shaw et al.
3,625,186 A 12/1971 Herbst
3,637,464 A 1/1972 Walsh et al.
3,639,111 A 2/1972 Brink et al.
3,711,593 A 1/1973 Shick et al.
3,718,446 A 2/1973 Brink et al.
3,761,568 A 9/1973 Brink et al.

(Continued)

FOREIGN PATENT DOCUMENTS

CA 1314447 3/1993

(Continued)

OTHER PUBLICATIONS

Anthony-Ross; "Industrial Equipment Manufacturer Optimizes New Equipment Design with Working Model"; obtained at the internet address: http://workingmodel.com/success/ss_spout.html; printed Oct. 21, 2005; 3 p.

(Continued)

*Primary Examiner*—Kenneth B Rinehart
*Assistant Examiner*—David J Laux
(74) *Attorney, Agent, or Firm*—Brinks Hofer Gilson & Lione

(57) ABSTRACT

A cleaning apparatus for cleaning a smelt spout of a boiler is provided. The boiler includes a boiler wall defining an outlet port for discharging molten smelt and the smelt spout is positioned with respect to the outlet port so that the molten smelt is able to flow along the smelt spout. The cleaning apparatus includes a cleaning tool having a pair of cleaning blades generally aligned with respective side walls of the smelt spout and an actuating assembly configured to move the cleaning blades from a first position to a second position. The cleaning blades each engage the respective side walls of the smelt spout to dislodge hardened smelt deposits therefrom when in the cleaning blades are in the second position.

29 Claims, 9 Drawing Sheets

U.S. PATENT DOCUMENTS

| | | | | | |
|---|---|---|---|---|---|
| 3,831,561 | A | | 8/1974 | Yamamoto et al. | |
| 3,870,467 | A | | 3/1975 | Nelson | |
| 3,873,413 | A | | 3/1975 | Fisher | |
| 4,011,047 | A | | 3/1977 | Tremblay | |
| 4,049,489 | A | | 9/1977 | Vegeby | |
| 4,099,471 | A | | 7/1978 | Sander et al. | |
| 4,115,108 | A | | 9/1978 | Ydstie | |
| 4,148,684 | A | | 4/1979 | Farin | |
| 4,166,192 | A | | 8/1979 | Ydstie | |
| 4,277,312 | A | | 7/1981 | McKenna et al. | |
| 4,361,441 | A | | 11/1982 | Tylko | |
| 4,369,054 | A | | 1/1983 | Shinholster, Jr. et al. | |
| 4,377,439 | A | | 3/1983 | Liem | |
| 4,421,596 | A | | 12/1983 | Högberg | |
| 4,423,533 | A | | 1/1984 | Goodspeed | |
| 4,462,319 | A | | 7/1984 | Larsen | |
| 4,538,552 | A | | 9/1985 | Smuda | |
| 4,653,409 | A | | 3/1987 | Eriksson | |
| 4,668,342 | A | | 5/1987 | Blackwell | |
| 4,682,985 | A | | 7/1987 | Kohl | |
| 4,706,324 | A | * | 11/1987 | Goodspeed | 15/246 |
| 4,748,004 | A | | 5/1988 | Goodspeed | |
| 4,750,649 | A | | 6/1988 | Fahey et al. | |
| 4,761,204 | A | | 8/1988 | Kohl et al. | |
| 4,822,428 | A | | 4/1989 | Goodspeed | |
| 4,823,710 | A | | 4/1989 | Garrido et al. | |
| 4,838,182 | A | | 6/1989 | Goodspeed | |
| 4,846,080 | A | | 7/1989 | Ross et al. | |
| 4,871,211 | A | | 10/1989 | Aussel | |
| 4,872,834 | A | | 10/1989 | Williams, Jr. | |
| 4,907,543 | A | | 3/1990 | Matranga et al. | |
| 4,941,945 | A | | 7/1990 | Pettersson | |
| 5,000,260 | A | | 3/1991 | Fontenot | |
| 5,001,992 | A | | 3/1991 | Higgins et al. | |
| 5,058,126 | A | | 10/1991 | Dosaj | |
| 5,107,798 | A | | 4/1992 | Gerep | |
| 5,167,192 | A | | 12/1992 | Pingel et al. | |
| 5,204,069 | A | | 4/1993 | Paxton et al. | |
| 5,284,550 | A | | 2/1994 | Tanca et al. | |
| 5,351,631 | A | | 10/1994 | Hill et al. | |
| 5,414,887 | A | | 5/1995 | Abel et al. | |
| 5,425,850 | A | | 6/1995 | Tanca et al. | |
| 5,437,768 | A | | 8/1995 | Smith et al. | |
| 5,542,650 | A | | 8/1996 | Abel et al. | |
| 5,545,292 | A | | 8/1996 | Empie | |
| 5,564,632 | A | | 10/1996 | Prohazka | |
| 5,584,264 | A | | 12/1996 | Moyer | |
| 5,628,875 | A | | 5/1997 | Lidén | |
| 5,635,095 | A | | 6/1997 | Kleinfeld | |
| 5,667,201 | A | | 9/1997 | Beveridge et al. | |
| 5,715,763 | A | | 2/1998 | Fornetti et al. | |
| 5,783,140 | A | | 7/1998 | Kleinfeld | |
| 5,800,773 | A | | 9/1998 | Beveridge et al. | |
| 5,824,275 | A | | 10/1998 | Bitzer et al. | |
| 5,827,475 | A | * | 10/1998 | Yamashiro et al. | 266/135 |
| 5,840,085 | A | | 11/1998 | Tokunaga et al. | |
| 5,976,319 | A | | 11/1999 | Paju et al. | |
| 6,018,471 | A | | 1/2000 | Titus et al. | |
| 6,055,943 | A | | 5/2000 | Cochrane et al. | |
| 6,111,232 | A | | 8/2000 | Kleinfeld | |
| 6,279,495 | B1 | | 8/2001 | Karidio et al. | |
| 6,302,039 | B1 | | 10/2001 | MacCallum et al. | |
| 6,319,358 | B1 | | 11/2001 | Winnick et al. | |
| 6,323,442 | B1 | | 11/2001 | Jones | |
| 6,431,125 | B1 | | 8/2002 | Eriksson | |
| 6,478,235 | B1 | | 11/2002 | Soderstrom et al. | |
| 6,497,230 | B1 | | 12/2002 | Higgins et al. | |
| 6,579,091 | B1 | | 6/2003 | Simonen | |
| 6,630,113 | B1 | | 10/2003 | Surma | |
| 6,672,227 | B2 | | 1/2004 | Nordenberg | |
| 6,689,309 | B1 | * | 2/2004 | Ranki | 266/135 |
| 2003/0070627 | A1 | | 4/2003 | Sullivan et al. | |
| 2003/0217706 | A1 | | 11/2003 | Pingel et al. | |
| 2004/0226758 | A1 | | 11/2004 | Jones et al. | |
| 2005/0039705 | A1 | | 2/2005 | Higgins et al. | |
| 2005/0056195 | A1 | | 3/2005 | Higgins et al. | |
| 2005/0109370 | A1 | * | 5/2005 | Eriksson et al. | 134/6 |

FOREIGN PATENT DOCUMENTS

| | | | |
|---|---|---|---|
| CA | 2078108 | | 10/1997 |
| CA | 2 462 751 | | 10/2004 |
| FR | 2 685 653 | A1 | 7/1993 |
| JP | 3028313 | | 2/2000 |
| WO | WO 00/29666 | | 5/2000 |
| WO | WO 03/093747 | A1 | 11/2003 |

OTHER PUBLICATIONS

Eie Maskin; "Automatic Cleaning of the Spout on Recovery Boilers"; obtained at the internet address: http://www.eie.se/english/cpk/spoutrod.shtml; printed May 2, 2006; 3p.

Eie Maskin; "Automatic Rodding of Spray Nozzle for Optimum Liquer Spraying"; obtained at the internet address: http://www./eie.se/english/cpk/sprayrod.shtml; printed May 2, 2006; 3p.

Sodahus-Teknik Iggesund; "Welcome" (shteknik/body); obtained at the internet address: http://shteknik.com/eng/bbody.htm; printed Apr. 27, 2006; 1 p.

Sodahus-Teknik Iggesund; "Products-OB-TVATT"; obtained at the internet address: http://shteknik.com/eng/prodob.htm; printed Apr. 27, 2006; 2p.

Sodahus-Teknik Iggesund; "Products-PeTo 1"; obtained at the internet address: http://shteknik.com/eng/prodpeto.htm; printed Apr. 27, 2006; 3p.

* cited by examiner

APPARATUS FOR CLEANING A SMELT SPOUT OF A COMBUSTION DEVICE

BACKGROUND

The invention relates to a cleaning apparatus for removing solidified smelt accumulations that block or restrict the discharge of smelt from a chemical recovery combustion chamber. More particularly, the invention relates to a cleaning apparatus and a smelt discharge assembly for removing solidified smelt accumulations from a smelt spout and from a combustion device outlet port.

Wood pulp for paper making is usually manufactured by a sulfate process, where wood chips are cooked in a cooking liquor (typically known as "white liquor") containing sodium sulfide and sodium hydroxide. After cooking, the used liquor (typically known as "black liquor") is washed out of the pulp and treated in a recovery unit where the cooking chemicals are refined. Without reclamation and reuse of the cooking chemicals, the cost of the paper-making process would be prohibitive.

The recovery unit typically includes boiler tubes extending along the interior of the boiler walls. Concurrently with the reclamation process, the heat from combustion process is utilized to generate process steam within the boiler tubes for generating electricity and/or for other applications.

During the recovery process, the black liquor is first concentrated by evaporation into a solution containing approximately 65 to 80 percent solids and the solution is sprayed into the internal volume of a chemical reduction furnace. Inside of the chemical reduction furnace, the organic materials in the black liquor are combusted by various processes such as evaporation, gasification, pyrolysis, oxidation, and reduction, thereby reducing the black liquor into a molten smelt of spent cooking chemicals. The molten smelt exits the furnace through a boiler outlet port and flows along a smelt spout to a collection tank. The boiler outlet port and the smelt spout are designed to drain the molten smelt from the internal volume of the furnace at a desired rate in order to maintain a safe smelt level within the furnace and in order to maximize the efficiency of the furnace, as will be discussed in more detail below.

The molten smelt exits the boiler at a temperature of approximately 1000 degrees Celsius and, upon contact with ambient air, a top layer of the smelt may cool enough to become hardened and form hardened deposits and/or a hardened crust on top of the molten smelt in the outlet opening and/or spout. Hardened smelt may obstruct the flow of the molten smelt, thereby reducing the effectiveness of the outlet port and smelt spout and causing the smelt level within the furnace to be undesirably high. Additionally, a reduced smelt flow may cause the molten smelt to remain in the smelt spout longer, thereby increasing the time that the smelt is subject to ambient temperatures and increasing the likelihood that more hardened deposits will form. Therefore, the hardened deposits may tend to form within the smelt spout at a rapid rate.

A high smelt level can cause a wide range of problems or undesirably low production levels. For example, a high smelt level may cause inefficient and unpredictable furnace operation, such as: a decrease in the amount of chemicals that can be recovered; a decrease in the process steam outputted from the boiler tubes; an increased emission of noxious gases such as carbon monoxide and sulfur dioxide. As another example, the hardened smelt may cause the molten smelt to splash out of the spout, thereby causing dangerous conditions for nearby workers and/or potentially causing property damage. Moreover, the smelt can build up to a dangerous level and either block furnace air ports, potentially causing the fire to be extinguished, or fill up the furnace windbox, causing serious corrosion problems or even causing smelt to pour out onto the floor adjacent the furnace. As yet another example, a high smelt level may cause a rapidly increase in temperature which may lead to a boiler explosion.

Typically, hardened deposits are manually dislodged from the outlet port and the spout at regular intervals. For example, workers hold a long rod with a tool attached to the distal end so as to scrape hardened deposits from the spout and/or outlet port. However, such manual rodding of the smelt spout and outlet port is inefficient, unsafe, and is a tedious, physically demanding job that may fatigue operators. Additionally, smelt spouts are cooled by water circulating in a water jacket surrounding the spout, which can become ruptured by improper rodding. A broken water jacket can result in an explosion in the furnace. Other dangers to workers include the potentially hazardous fumes from the collection tank. Furthermore, the regular intervals at which the hardened smelt must be removed causes labor costs to be undesirably high.

Recently, automated devices have been used to automatically, periodically scrape hardened deposits from the spout and/or outlet port. For example, U.S. Pat. No. 4,706,324, which issued Nov. 17, 1987, discloses a smelt spout cleaner that is mounted on or above the smelt spout. A housing is mounted above the smelt spout and, at regular intervals, a cleaning head assembly swings in a downward, sweeping stroke from the housing towards the spout to clean deposits from the boiler outlet port and then swings in an upward, sweeping stroke toward the housing so as to mirror the downward stroke and to clean deposits from the spout. The cleaning head assembly includes a cleaning head that enters the boiler outlet port on the downward stroke. Additionally, the cleaning head assembly includes pivotable channel scraping members that each has a shape and size that generally matches that of the spout. During the downward stroke, the channel scraping members each pivot into a collapsed state to ride on the top of the molten smelt flow rather than entering the flow. Then, during the upward stroke, the channel scraping members pivot back into an extended state and are scraped along the side and bottom walls of the spout.

However, because the width of each of the channel scraping members is generally equal to the width of the spout, the flow of molten smelt is disrupted by the scraping members during the upward stroke, thereby potentially causing the molten smelt to splash or overflow from the spout. Additionally, although the hardened smelt deposits generally only occur at the top layer of the smelt flow, the channel scraping members in the '324 patent each scrape along the bottom walls of the smelt spout, thereby exposing the entire spout to potential premature wear when only select portions of the spout require regular cleaning. Furthermore, the design disclosed in the '324 patent only cleans the spout along arcuate cleaning paths traveled by the scraping members so that portions of the spout that lie between the cleaning paths may remain uncleaned. Conversely, if additional scraping members are added to the design disclosed in the '324 patent to minimize gaps between the cleaning paths, then the spout may be subject to unnecessary part wear. Additionally, the upward cleaning stroke lifts the hardened smelt deposits upwards and out of the smelt spout, increasing the possibility of smelt splash and/or overflow.

Another automated device for scraping hardened deposits from the spout and outlet port is disclosed in U.S. Pat. No. 5,542,650, which issued on Aug. 16, 1996. The '650 patent discloses a cleaning head assembly that travels along a smelt spout in a direction generally parallel thereto to scrape hardened deposits from the spout walls. More specifically, the cleaning head assembly includes a plurality of U-shaped paddles that have a size and shape corresponding to that of the smelt spout so that the paddles fit within the spout and dislodge hardened deposits from the surfaces thereof as they are moved along a substantial portion of the length of the spout.

However, because the width of each of the paddles is generally equal to the width of the spout, the flow of molten smelt is disrupted by the paddles, thereby potentially causing the molten smelt to splash or overflow from the spout. Additionally, although the hardened smelt deposits generally only occur at the top layer of the smelt flow, the paddles each scrape along the bottom walls of the smelt spout, thereby exposing the entire spout to potential premature wear when only select portions of the spout require regular cleaning. Furthermore, because the cleaning head assembly is translated along a substantial length of the smelt spout during cleaning, the cleaning cycle may take an undesirable amount of time to complete.

As seen from above, it is desirous to provide an improved smelt spout assembly and a cleaning apparatus for cleaning a smelt spout to improve the efficiency and effectiveness with which a smelt spout and/or a boiler outlet port can be cleaned.

SUMMARY

In overcoming the disadvantages and drawbacks of the known technology, one aspect of the current invention provides a cleaning apparatus for cleaning a smelt spout of a combustion device so that molten smelt is able to flow from the combustion device along a flow path of the smelt spout. The apparatus includes a cleaning tool having a pair of blades that are generally aligned with side walls of the smelt spout, and an actuating assembly that moves the cleaning blades from a retracted position to an extended position to dislodge the hardened smelt deposit from the side walls of the smelt spout.

In one design, the cleaning blades are elongate blades. Additionally, the blades each preferably extend substantially completely along the length of the smelt spout. The blades are also preferably planar and each preferably has a relatively small thickness so as to permit the molten smelt to flow along the smelt spout substantially unobstructed.

In another design, the cleaning blades move along a cleaning path from the retracted position to the extended position, and the cleaning path and a normal line that is generally perpendicular to the flow path define a cleaning angle therebetween that is less than or equal to 60 degrees. As a more specific example, the cleaning angle is less than or equal to 45 degrees. The cleaning path is also preferably generally linear.

In one design, the apparatus includes a support assembly, such as a hood, connected to the smelt spout and the cleaning tool to permit the movement of the cleaning tool from the retracted position to the extended position. Additionally, hood preferably includes a pair of hood side walls each connected to the smelt spout and each positioned adjacent to one of the cleaning blades. The hood further includes a pair of connection assemblies each slidably coupling one of the cleaning blades with one of the hood side walls. For example, the connection assemblies each include a support rod and a sleeve slidably receiving the support rod to slidably couple the one of the cleaning blades and the hood side walls.

In another design, the smelt spout includes a collar portion positioned within the boiler wall outlet port and the cleaning tool includes a front portion adapted to slide along a surface of the smelt spout collar portion to remove hardened smelt deposits therefrom.

In another aspect of the present invention, a smelt discharge assembly is provided for facilitating the removal of molten smelt from a combustion device, including: a smelt spout having a pair of side walls and a bottom wall defining a trough, a cleaning tool movable along a cleaning path from a retracted position to an extended position to dislodge a hardened smelt deposit from the side walls of the smelt spout, and an actuating assembly configured to move the cleaning blades along the cleaning path.

The above configurations of the present invention provide an improved smelt spout assembly and apparatus for cleaning a smelt spout, thereby potentially improving the efficiency and the overall effectiveness with which a smelt spout and/or a boiler outlet port can be cleaned

DETAILED DESCRIPTION

Figure 1A:
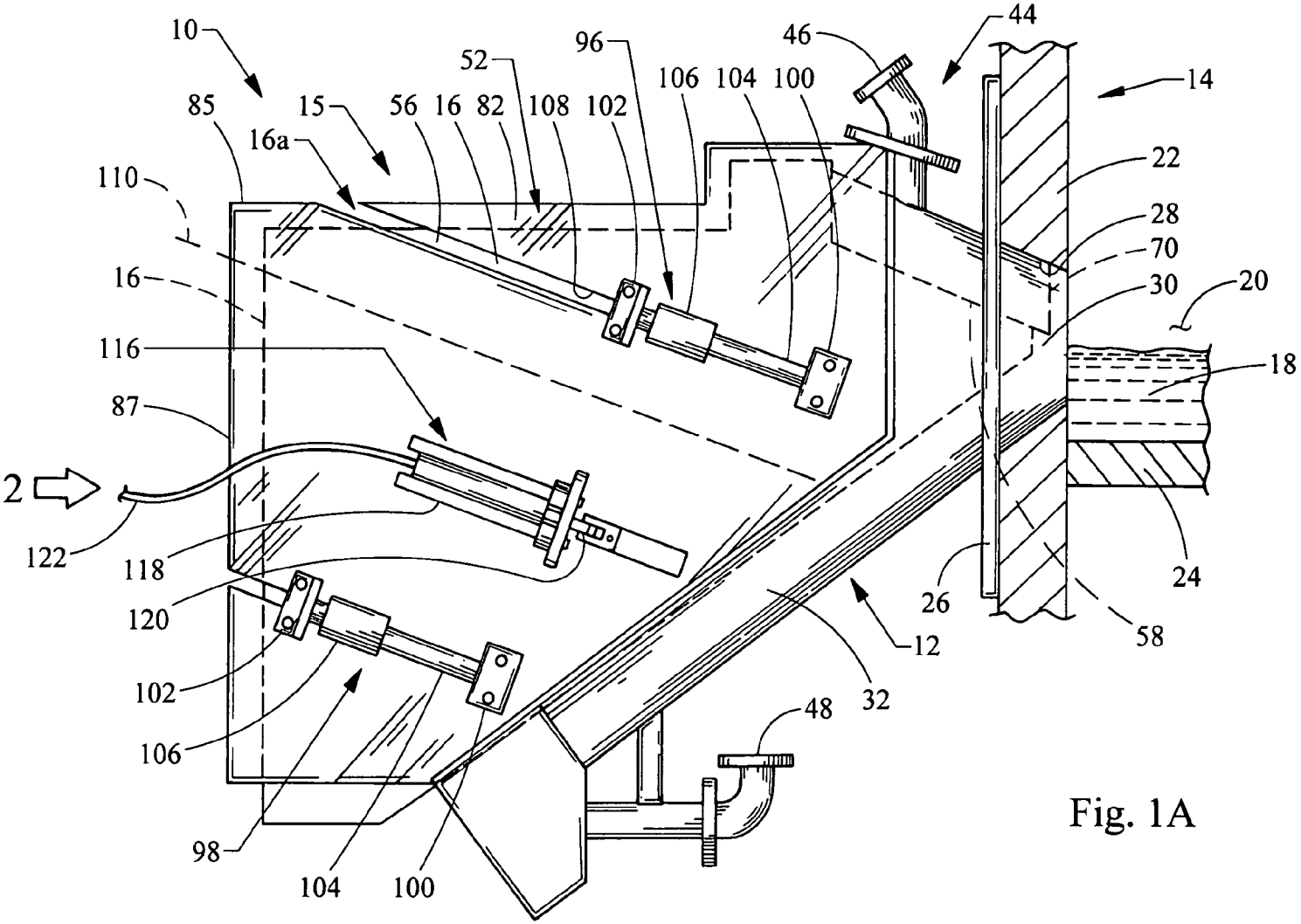
FIG. 1*a* is a side view of a smelt discharge assembly according the principles of the present invention, having a smelt spout connected to a boiler wall and a cleaning tool for dislodging hardened smelt from the smelt spout, where the cleaning tool is in a retracted position.
Figure 1B:
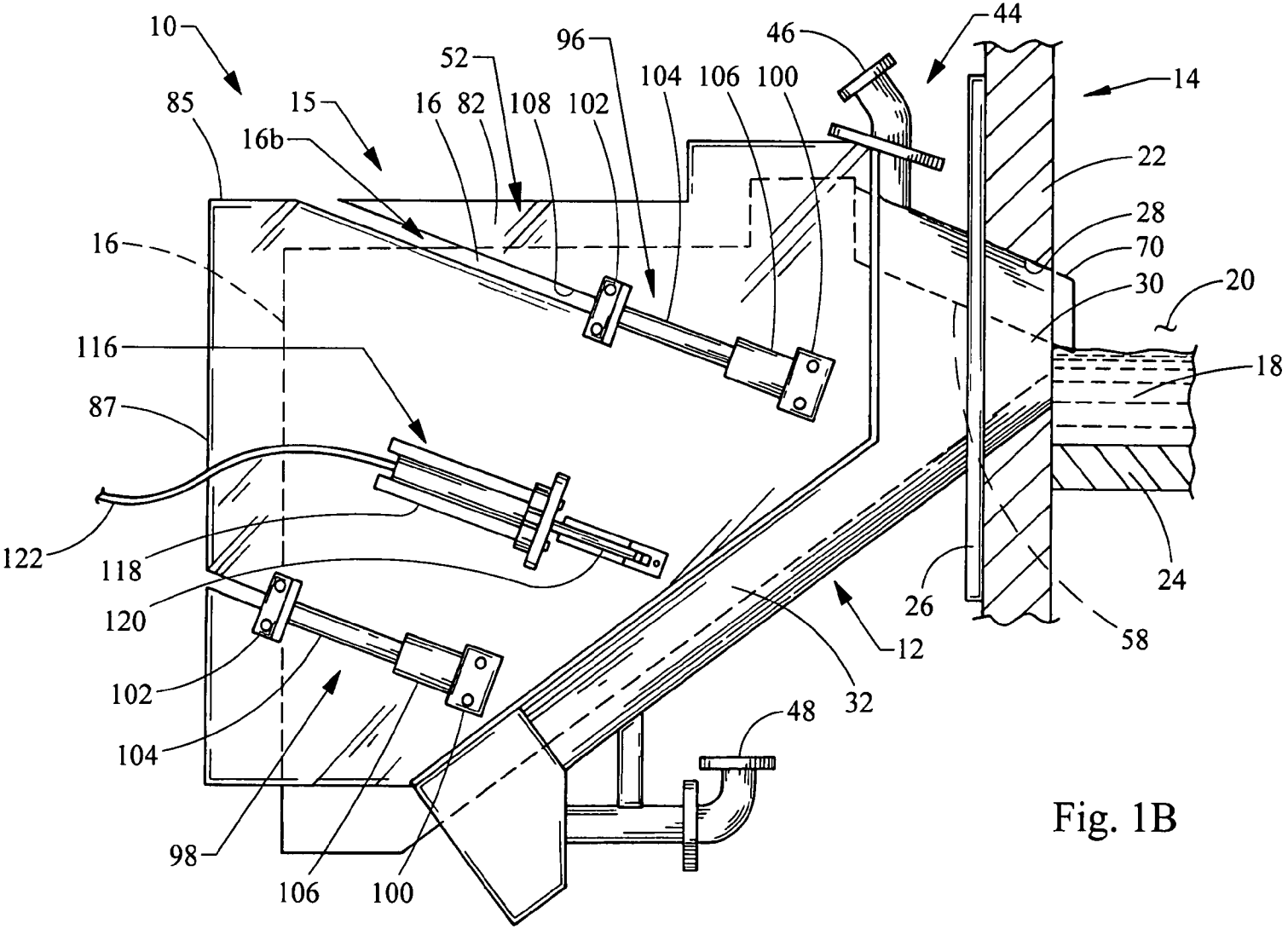
FIG. 1*b* is a side view of the smelt discharge assembly shown in FIG. 1*a,* where the cleaning tool is in an extended position.

Referring now to the present invention, FIG. 1*a* is a smelt discharge assembly 10 according the principles of the present invention, having a smelt spout 12 connected to a boiler 14 and a cleaning apparatus 15 for cleaning the smelt spout 12. The cleaning apparatus 15 generally includes: a cleaning tool 16 connected to the smelt spout 12 for dislodging hardened smelt from the smelt spout 12; a hood 52 for supporting the cleaning tool and providing protection from splashing molten smelt; and an actuating mechanism 116 for moving the cleaning tool 16 between a retracted position 16*a* (shown in FIGS. 1*a,* 2, 3*a,* 4*a,* and 5*a*) and an extended position 16*b* (shown in FIGS. 1*b,* 3*b,* 4*b,* and 5*b*) for dislodging the hardened smelt deposits from the smelt spout 12.

The boiler 14 is a combustion device, such as a chemical recovery furnace, that drains recycled byproducts, such as molten smelt 18, from an internal volume 20 of the boiler 14 to a collection tank (not shown) via the smelt spout 12. The boiler internal volume 20 is defined by boiler side walls 22 having generally vertical steam tubes (not shown) that capture and utilize heat energy from the boiler internal volume 20 and by a generally horizontal boiler bottom wall 24 that intersects the boiler side wall 22 adjacent to a point where the smelt spout 12 is mounted so that the molten smelt 18 is able to flow into the smelt spout 12. The smelt spout 12 is secured to the boiler 14 by a mounting plate 26 and is in fluid connection with the boiler internal volume 20 via an outlet port 28 formed in the boiler side wall 22.

Figure 2:
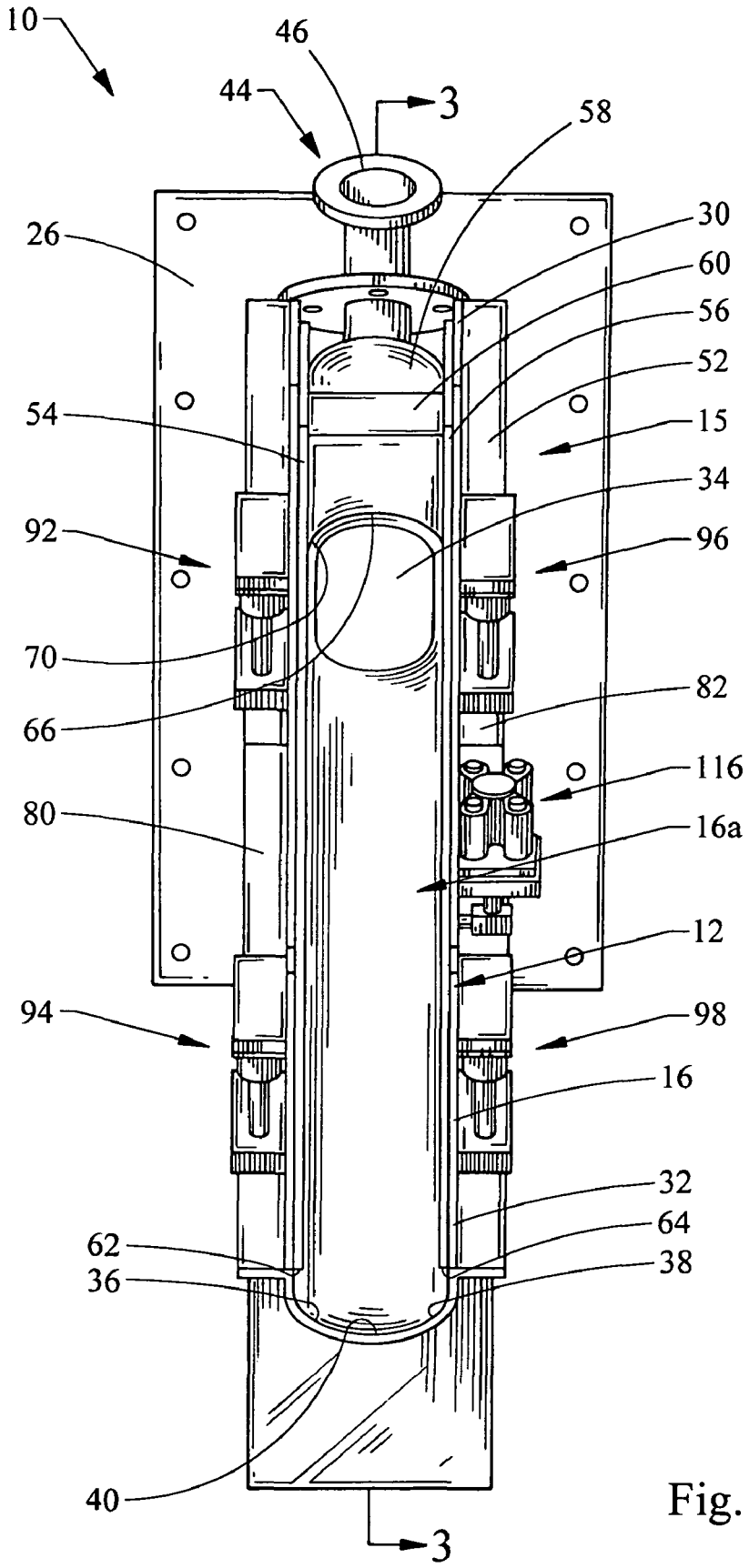
FIG. 2 is a rear view of the smelt discharge assembly shown from line 2-2 in FIG. 1*a;*

The smelt spout 12 includes a collar 30 extending through the outlet port 28 and a trough 32 connected to the collar 30 and extending away therefrom towards the collection tank. The collar 30 preferably has an annular ring shape and is fluidly connected to the boiler internal volume 20 to minimize potential damage from smelt splashing or overflow to the following: the boiler side wall outlet port 28, another other nearby component, or a nearby worker. More specifically, the collar 30 preferably defines a generally oval-shaped passageway 34 (as best shown in FIG. 2) so as to matingly fit within industry-standard boiler openings. Additionally, the oval-shaped passageway 34 preferably has an increasing diameter in a direction extending away from the boiler internal volume 20 so as to improve the accessibility of the collar 30 during cleaning, as will be discussed in more detail below. Alternatively, the present invention may be used in conjunction with a smelt spout having a trough that receives molten smelt directly from a boiler outlet port, rather than from a collar that is received within the boiler outlet port.

The trough 32 of the smelt spout extends away from the collar 30 at a downward slope so that gravitational forces cause the molten smelt 18 to flow towards the collection tank. Unlike the collar 30, the trough 32 is preferably open along the top thereof so that the molten smelt 18 is accessible while flowing through the smelt spout 12. This configuration is particularly advantageous for cleaning the trough 32, as will be discussed further below. The trough 32 preferably has a U-shaped cross section defined by a pair of side walls 36, 38 and a bottom wall 40 so that the opening along the top of the smelt spout 12 is at least as wide as the widest portion of the trough 32 to further improve access to the molten smelt 18. Although the smelt spout 12 shown in the figures is a single, unitary component, it may be formed from several components that are fastened together or unitarily formed with each other.

Figure 3A:
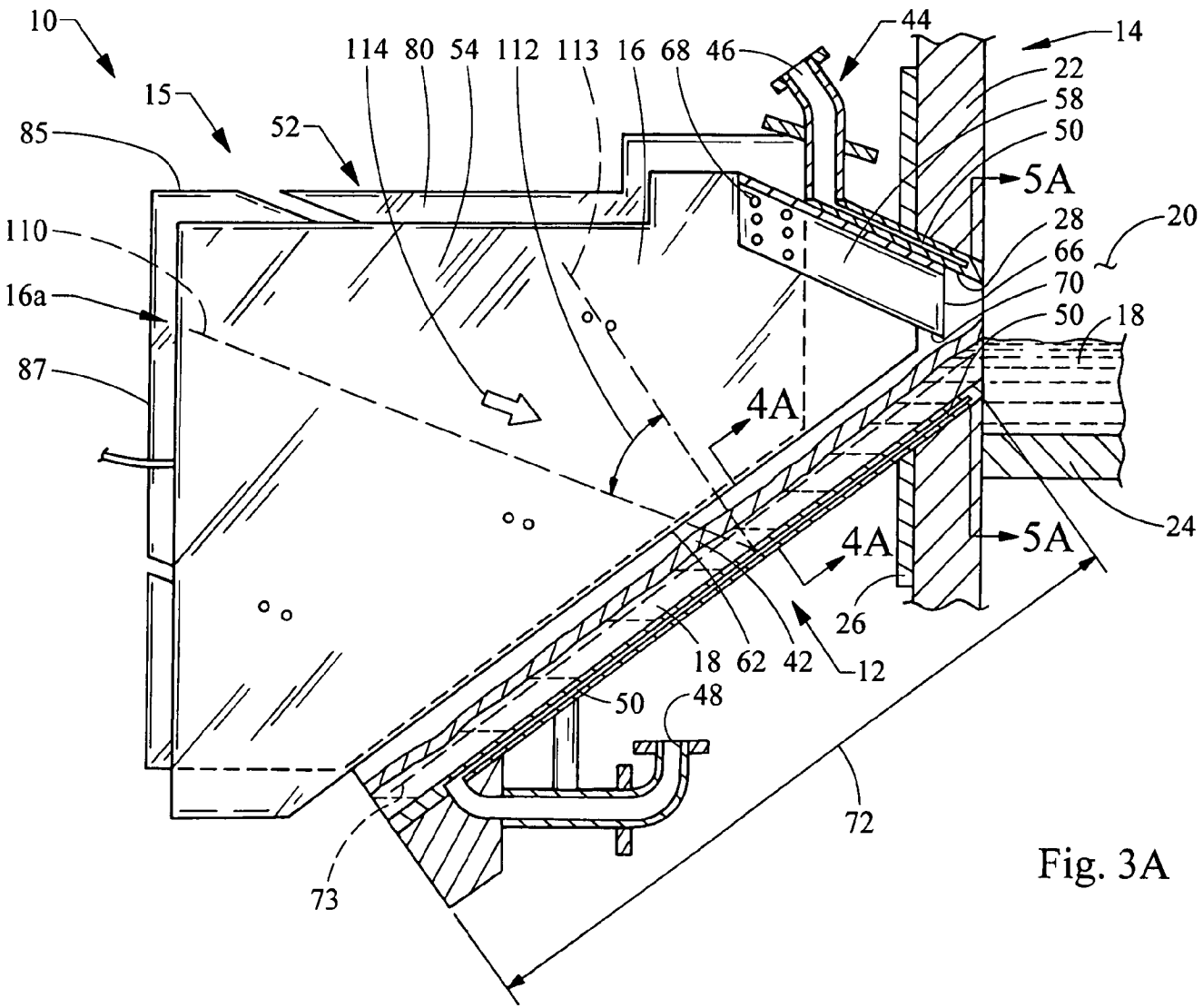
FIG. 3*a* is a cross-sectional view taken along line 3-3 in FIG. 2, where the cleaning tool is in the retracted position.
Figure 4A:
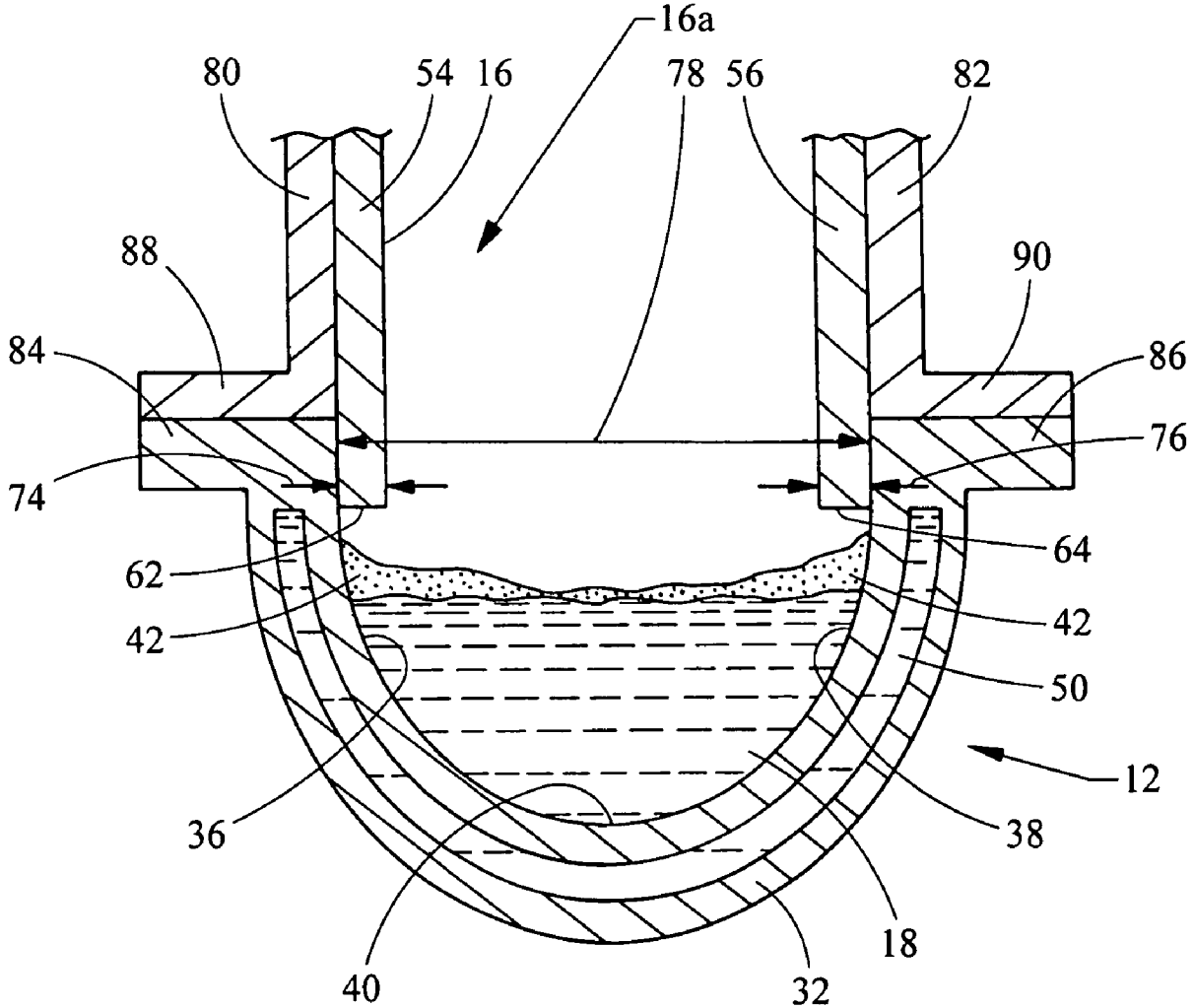
FIG. 4*a* is a cross-sectional view taken along line 4*a*-4*a* in FIG. 3*a,* where the cleaning tool is in the retracted position.
Figure 5A:
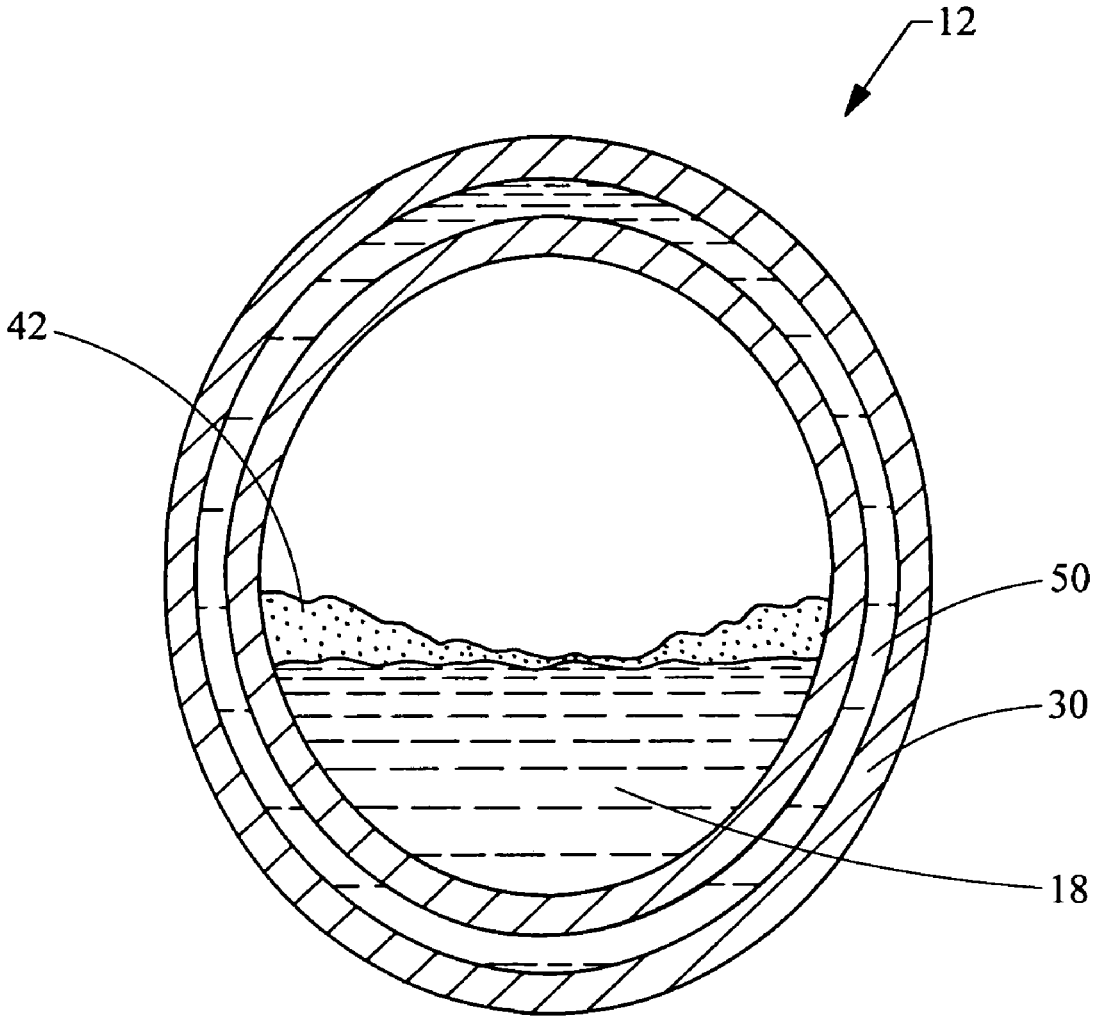
FIG. 5*a* is a cross-sectional view taken along line 5*a*-5*a* in FIG. 3*a,* where the cleaning tool is in the retracted position.
Figure 5B:
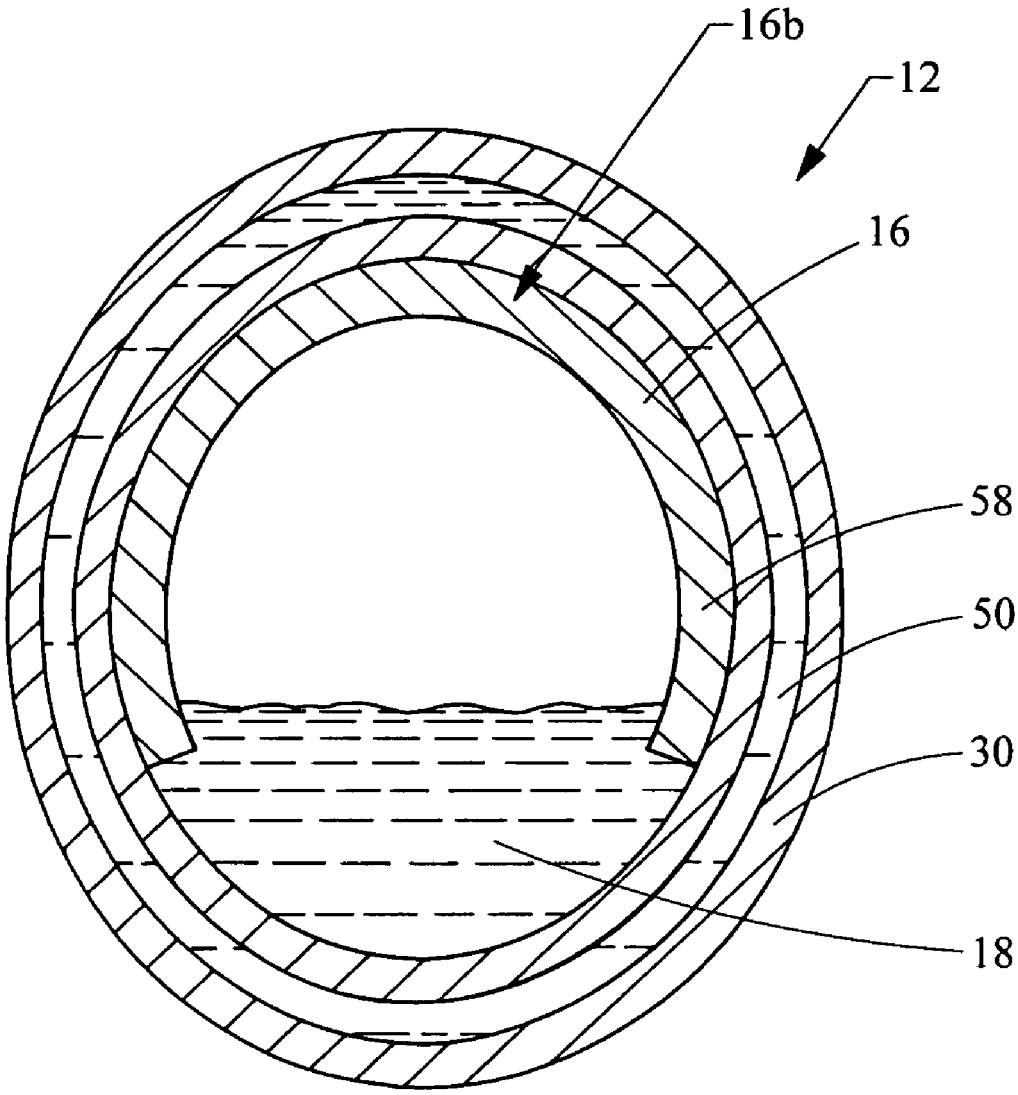
FIG. 5*b* is a cross-sectional view taken along line 5*b*-5*b* in FIG. 3*b,* where the cleaning tool is in the extended position.

When the molten smelt 18 exits the internal volume 20 of the boiler 14 and is exposed to ambient air, the molten smelt 18 cools and may become hardened. For example, hardened deposits 42 (as best shown in FIGS. 3*a*, 4*a*, and 5*a*) may form on the surfaces of the smelt spout 12 and/or on top of the molten smelt 18 flowing down the smelt spout 12. More specifically, the hardened deposits 42 typically form as isolated deposits on the upper surfaces of the smelt spout 12 where the molten smelt 18 reached its highest point. Additionally, these isolated deposits often become fused with a crust-like top layer that bridges across the smelt spout 12 between the side walls 36, 38 thereof. The hardened deposits 42 generally obstruct and/or reduce flow of the molten smelt 18, thereby reducing the effectiveness of the boiler 14 as discussed above.

Although it is desirable to maintain the molten smelt 18 at a relatively high temperature within the smelt spout 12 to minimize the formation of the hardened deposits 42, it is also undesirable for the smelt spout 12 to become overheated. Therefore, a water jacket 44 is present within the smelt spout 12 to maintain a desired internal temperature. The water jacket 44 shown in the figures includes an inlet 46 near the top of the smelt spout 12, an outlet 48 near the lower end of the smelt spout 12, and a network of cooling ducts 50 (best shown in FIGS. 3*a*-5*b*) transporting the a cooling fluid therebetween. More specifically, the cooling ducts 50 are formed by internal surfaces of the smelt spout 12 in the smelt spout collar 30 and trough 32. The inlet 46 is supplied with a continuous supply of relatively cool fluid, such as water. The cooling ducts 50 may be present within any portion of the smelt spout 12 that is subject to high temperatures, or they may be limited to the lower surfaces thereof so as to maintain a relatively high temperature in the portions of the smelt spout 12 that typically develop hardened deposits 42.

As mentioned above, the cleaning tool 16 is connected to the smelt spout 12 for dislodging hardened smelt from the smelt spout 12. The cleaning tool 16 is movably coupled with the smelt spout 12 via a support assembly, such as the hood 52, that is connected to the smelt spout 12, as will be discussed in more detail below. As best shown in FIGS. 2-5*b*, the cleaning tool 16 includes a pair of elongate blades 54, 56 for removing hardened deposits from the smelt spout trough 32 and a front portion, such as a generally arcuate punch 58, for removing hardened deposits from the smelt spout collar 30.

The blades 54, 56 are relatively large sheets that each are aligned with respective side walls 36, 38 of the smelt spout trough 32 and extend therealong. More specifically, the blades 54, 56 are each aligned with respective side walls 36, 38 of the smelt spout trough 32 so as to slide along the side walls 36, 38 when the cleaning tool is moved into the extended position 16*b*. Additionally, the blades 54, 56 are each preferably relatively large, planar blades made from sheet metal. The blades 54, 56 are coupled with each other via one or more bridge portions 60 (FIG. 2) so as to move in unison between the retracted and extended positions 16*a*, 16*b*.

The blades 54, 56 each have a cleaning edge 62, 64 for dislodging the hardened deposits 42 from the respective side walls 36, 38 of the trough 32. More specifically, the cleaning edges 62, 64 are designed to shear the hardened deposits 42 from the side walls 36, 38 so that the hardened deposits 42 are permitted to flow with the molten smelt 18 down the trough 32. The cleaning edges 62, 64 are preferably formed from a hardened metal that is capable of maintaining its properties throughout frequent exposure to molten materials. Additionally, although the cleaning edges 62, 64 shown in the figures are generally square edges, they may alternatively have a tapered shape or any other suitable design.

The cleaning edges 62, 64 of the blades 54, 56 each preferably extend substantially completely along a length 72 of the smelt spout 12 so that the hardened deposits 42 can be removed in a single stroke of the cleaning tool 16, thereby reducing the time required to clean the smelt spout 12. More specifically, the cleaning edges 62, 64 each preferably extend substantially completely along a flow path 73 of the molten smelt 18 between the boiler 14 and the collection tank.

Figure 4B:
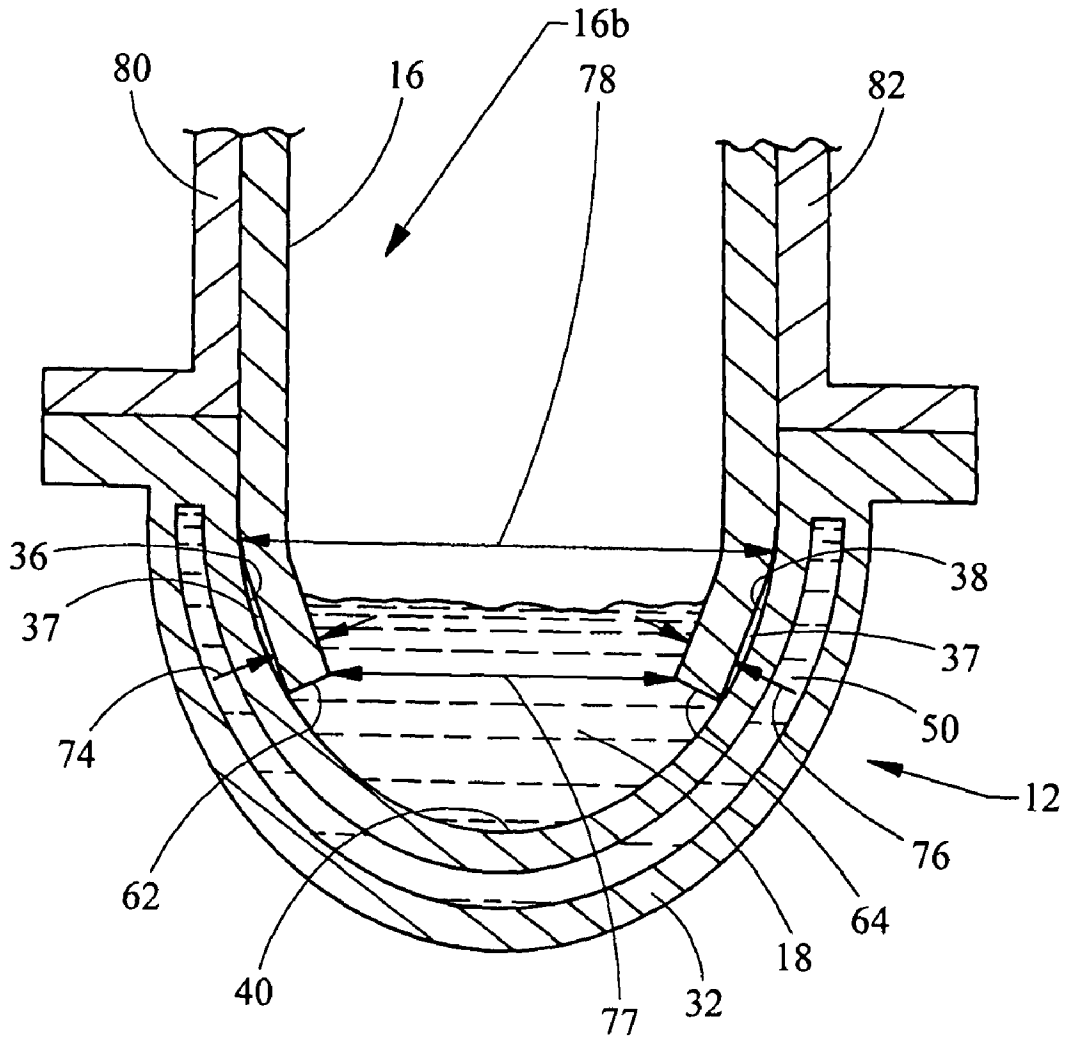
FIG. 4*b* is a cross-sectional view taken along line 4*b*-4*b* in FIG. 3*b,* where the cleaning tool is in the extended position.

As best shown in FIGS. 4*a* and 4*b*, each of the cleaning edges 62, 64 of the blades 54, 56 has a thickness 74, 76 that is substantially small enough so that the flow of molten smelt 18 is substantially uninterrupted by the cleaning edges 62, 64 when the cleaning tool is in the extended position 16*b*. For example, the blade thicknesses 74, 76 are each so small that an effective width 77 (FIG. 4*b*) of the trough 32 when the cleaning tool 16 is in the extended position 16*b* is only slightly smaller than an actual width 78 of the trough 32. For example, the respective thicknesses 74, 76 of the cleaning edges 62, 64 are each preferably between 2 and 4 millimeters and the width 78 of the trough 32 is typically between 100 and 200 millimeters.

Referring back to FIGS. 1-3*b*, 5*a*, and 5*b*, the punch 58 is a metal sheet having a generally horseshoe shaped cross-section matching that of the smelt spout collar 30 so as to remove the hardened deposits 42 therefrom. More specifically, the outer surface of the punch 58 slides along the inner surface of the collar 30 as the cleaning tool 16 moves into the extended position 16*b*. A bottom portion 70 of the punch 58 includes a gap between respective sides of the punch 58 (best shown in FIG. 5*b*) so as to permit the molten smelt 18 to flow along the smelt spout 12 unobstructed. The punch 58 is connected to each of the blades 54, 56 via fasteners 68, or any other appropriate connection means, so that the blades 54, 56 and the punch 58 move in unison with each other between the retracted and extended positions 16*a*, 16*b*. Alternatively, the blades 54, 56 and the punch 58 may be formed of a single, unitary component.

Similarly to the blades 54, 56, the punch 58 includes a cleaning edge 66 designed to shear the hardened deposits 42 from the walls of the collar 30 so that the hardened deposits 42 flow with the molten smelt 18 along the smelt spout 12 and into the collection tank. The cleaning edge 66 is therefore preferably formed from a hardened metal that is capable of maintaining its properties throughout frequent exposure to molten materials. The cleaning edge 66 may have any suitable shape such as a tapered or a squared design.

As mentioned above, the cleaning tool 16 is movable from the retracted position 16*a* (shown in FIGS. 1*a*, 2, 3*a*, 4*a*, and 5*a*) to then extended position 16*b* (shown in FIGS. 1*b*, 3*b*, 4*b*, and 5*b*) for dislodging hardened smelt deposits from the smelt spout 12. When the cleaning tool 16 is moved into the extended position 16*b*, the hardened deposits 42 (shown in FIGS. 1*a*, 2, 3*a*, 4*a*, and 5*a*) are sheared from the surfaces of the smelt spout 12 and driven downward into the molten smelt 18. The deposits 42 that are driven into the molten smelt 18 flow down the smelt spout 12. Additionally, any additional deposits 42 that bridged the width of the smelt spout 12 are left unattached to the smelt spout 12 and are free to flow down the smelt spout 12. Some or all of the deposits 42 may become molten after rejoining the flow of the molten smelt 18. It may be desirable to clean the smelt spout 12 frequently enough to prevent or substantially prevent hardened deposits from bridging the width of the smelt spout 12. Alternatively, it may be desirable to manually urge the loosened deposits down the smelt spout 12 after they have been dislodged from the smelt spout surfaces.

As also mentioned above, the hood 52 movably couples the cleaning tool 16 with the smelt spout 12 so that the cleaning tool 16 is movable between the retracted position 16*a* and the extended position 16*b*. The hood 52 includes a pair of side walls 80, 82 that are each connected to the respective sides of the trough 32 and that each extend generally parallel to the blades 54, 56 so that the outboard side or each blade 54, 56 engages the inboard side of the respective side wall 80, 82. More specifically, each of the side walls 80, 82 have a horizontal connection flange 88, 90 extending along the length thereof and each side wall 36, 38 of the trough 32 has a corresponding connecting flange 84, 86 extending along the length thereof. The respective sets of connection flanges 84, 88 and 86, 90 are connected with each other via appropriate connection means such as fasteners, clamps, or welding.

A safety wall may connect the hood side walls 80, 82 along a top 85 and/or a back 87 of the hood 52. The safety wall provides stability to the hood 52 and/or provides protection against smelt splashing and/or accidental access to the smelt spout 12. The safety wall may be movably connected to the hood 52 so as to permit selective access to the smelt spout 12 for inspection, maintenance, or manual smelt rodding. For example, the top 85 and/or the back 87 of the hood 52 may include a removable safety wall, a pivoting safety wall, or another suitable design granting temporary access to the smelt spout 12. If the safety wall completely encloses the cleaning tool 16, it may be beneficial to provide a video camera or another surveillance device to monitor the buildup of hardened smelt 42. Alternatively, a control mechanism may be utilized to automatically actuate the cleaning tool 16 every desired time period. Alternatively, it may be advantageous to leave the back 87 of the hood 52 open to provide manual access to the smelt spout when the assembly 10 is in use.

The hood 52 also includes a plurality of connection assemblies 92, 94, 96, 98 that slidably couple the cleaning tool 16 to the hood 52. More specifically, each of the connection assemblies 92, 94, 96, 98 includes a pair of base mounts 100, 102 that are connected to the side walls of the hood 52 and that support a rod 104 extending therebetween and a sleeve mount 106 that is connected to the blades of the cleaning tool 16 through a slot 108 in the side walls 80, 82 and that slidably receives the rod 104. Alternatively, the cleaning tool 16 may be movably coupled to the hood 52 by an integral portion of the hood 52.

The base mounts 100, 102 are each preferably metal blocks that are connected to the outboard sides of the side walls 80, 82 of the hood 52 and that have indentations or channels formed therein for receiving the respective rods 104. The base mounts 100, 102 serve to provide a stable connection between the cleaning tool 16 and the hood 52 and to limit the distance that the cleaning tool 16 can travel, as will be discussed in further detail below.

The sleeve mount 106 is preferably a cylindrical shaped sleeve that has an inner surface corresponding to the outer diameter of the rod 104 and an outer surface that is connected to one of the blades 54, 56 via a connecting arm (not shown) that extends through the slot 108. The sleeve mount 106 has a longitudinal length that is sufficient to prevent binding between the sleeve mount 106 and the rod 104. Similarly, the inner surface of the sleeve mount 106 and the outer surface of the rod 104 each preferably have relatively low coefficients of friction to prevent binding.

The slots 108 each at least extend substantially completely between the respective base mounts 100, 102 to permit travel of the sleeve mount therebetween. However, the design shown in the figures have slots 108 extending from the far base mount 100 to the edge of the side walls 80, 82 so that the blades 54, 56 can be easily removed from the hood 52 during assembly and maintenance, by removing the base mounts 100, 102 and sliding the sleeve mounts 106 along the slots 108.

The respective slots 108 and the rods 104 are preferably parallel with each other so that the sleeve mounts 106 all move in unison with each other along the same path. Therefore, the cleaning tool 16 moves along a cleaning path 110 between the retracted position 16*a* and the extended position 16*b*. The cleaning path 110 is preferably nonparallel to the flow path 73 so that the hardened deposits 42 are quickly sheared from the trough rather than being dragged therealong in a drawn-out motion. This configuration minimizes the time required to perform the cleaning operation.

The cleaning path 110 cooperates with the molten smelt flow path 73 to define a cleaning angle 112 between the cleaning path 110 and a normal line 113 that is generally perpendicular to the molten smelt flow path 73. To increase the effectiveness of the cleaning tool 16, the cleaning angle 112 is preferably less than or equal to 60 degrees. More preferably, cleaning angle 112 is preferably between less than or equal to 45 degrees. The cleaning path 110 is also preferably generally parallel with the upper surface of the collar 30 so that the outer surface of the punch 58 slides along the inner surface of the collar 30 when the cleaning tool 16 moves between the respective positions 16*a*, 16*b*. the cleaning path 110 shown in the figures is linear, but the cleaning tool 16 may travel along any other suitable path, such as an arcuate cleaning path.

When the cleaning tool 16 moves from the retracted position 16*a* to the extended position 16*b*, the cleaning tool 16 moves in a cleaning direction 114 that is generally downward towards the trough bottom wall 40. This configuration is desirable because the hardened deposits 42 are driven into the molten smelt 18 rather than being dragged along the top surface of the smelt flow or being lifted out of the smelt flow. For example, as the cleaning tool 16 moves downward toward the extended position 16*b*, the hardened deposits 42 are forced into the molten smelt 18 and are able to flow along the trough 32. The hardened deposits 42 forced into the molten smelt 18 may become molten, thereby improving the flow along the smelt spout 12. Also, the downward cleaning direction 114 minimizes smelt splash and/or overflow.

The side walls 36, 38 of the trough 32 are generally arcuate. Furthermore, the blades 54, 56 are positioned flat against the hood side walls 80, 82 so as to minimize lateral movement of the blades 54, 56. Therefore, as the cleaning tool 16 moves from the retracted position 16*a* to the extended position 16*b*, the cleaning edges 62, 64 remain engaged with the side walls 36, 38 of the trough 32, thereby deflecting inward toward each other. This configuration maximizes the scraping force on the side walls 36, 38 for removing the hardened deposits 42. Although the blades 54, 56 may bend in a generally linear fashion so as to form gaps 37, the gaps 37 are relatively small so that the effective width 77 of the trough 32 is not substantially diminished. Alternatively, the blades 54, 56 may each have a blade stiffness suitable to substantially prevent inward deflection of the blades 54, 56 when the cleaning tool is in the extended position 16*b* such as to remove hardened deposits 42 without deflecting.

Figure 3B:
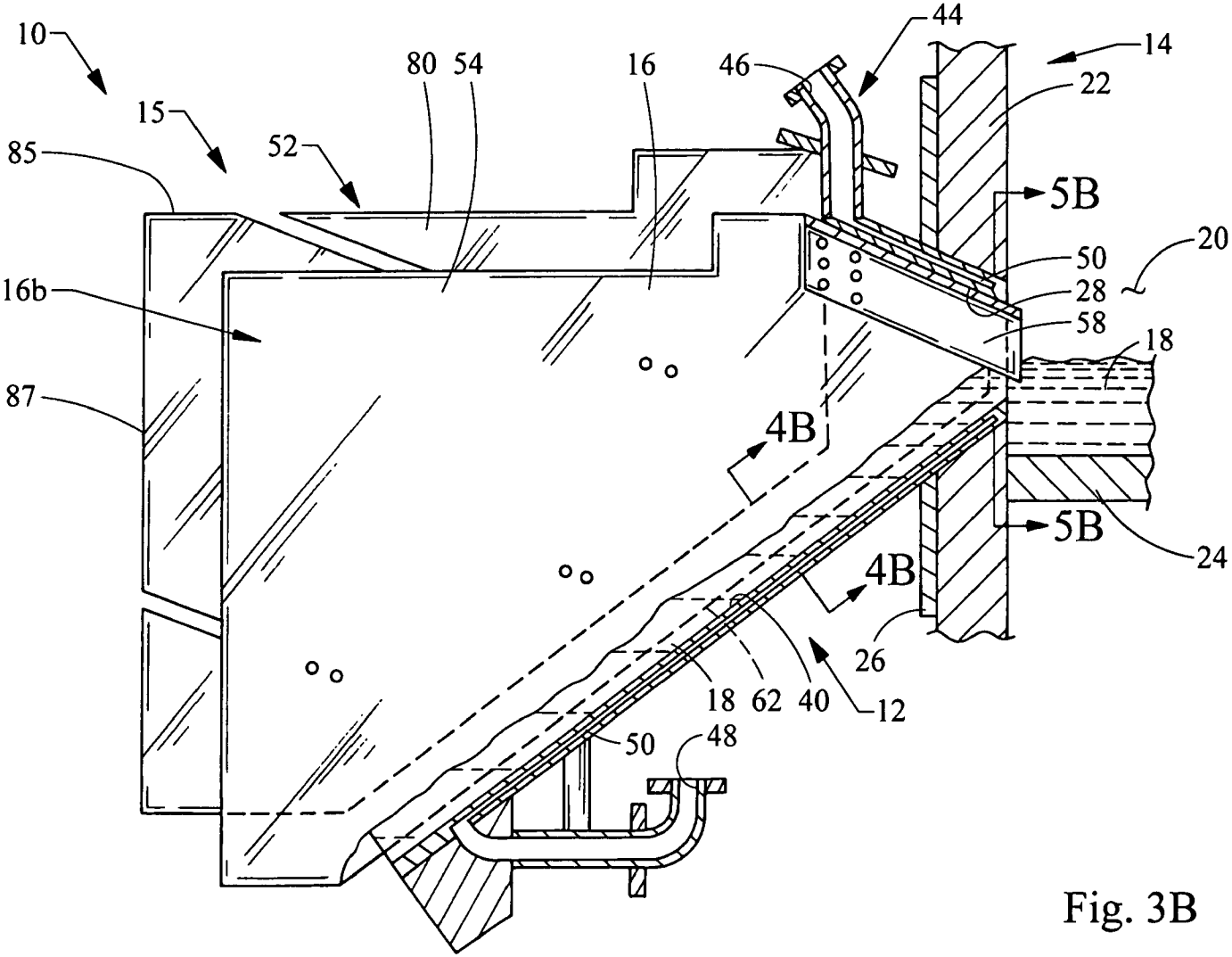
FIG. 3*b* is a cross-sectional view taken along line 3-3 in FIG. 2, where the cleaning tool is in the extended position.

Additionally, the arcuate side walls 36, 38 generally prevent the blades from reaching the bottom wall 40 of the trough, thereby preventing unnecessary wear to a component of the trough that does not regularly have hardened deposits 42 formed thereon and thereby minimizing the likelihood of damage to the water jacket 44. Additionally, the base mounts 100, 102 are positioned such that the sleeve mount 106 abuts the lower base mount 100 when the cleaning edges 62, 64, 66 are at a desired level in the smelt spout 12, thereby also preventing the cleaning tool 16 from contacting the smelt spout bottom walls 40. For example, as best shown in FIGS. 3*b* and 4*b*, the cleaning edge 62 is slightly submerged in the molten smelt 42 but does not reach the trough bottom wall 40.

The smelt discharge assembly 10 further includes an actuating mechanism, such as a linear actuator in the form of a piston assembly 116 coupled with the hood 52 and the cleaning tool 16 so as to actuate the cleaning tool 16 from the retracted position 16*a* to the extended 16*b* position. The piston assembly 116 shown in the figures includes a piston body 118 attached to the hood 52 and a piston arm 120 slidably received within the piston body 118 that is attached to the cleaning tool 16. Also, the piston assembly includes a power source 122, such as a hydraulic or pneumatic hose that actuates the piston arm 120. Alternatively, the actuating mechanism may include screw drive mechanism or another suitable device for controlling the position of the cleaning tool 16.

It is therefore intended that the foregoing detailed description be regarded as illustrative rather than limiting, and that it be understood that it is the following claims, including all equivalents, that are intending to define the spirit and scope of this invention. More particularly, the apparatus and assembly described are merely an exemplary apparatus and assembly, and they are not intended to be limiting. Many of the steps and devices for performing the steps described above may be eliminated or replaced by alternative steps and devices.

What is claimed is:

1. A cleaning apparatus for cleaning a smelt spout of a boiler, the smelt spout having side walls and a bottom wall extending therebetween, the boiler including a boiler wall defining an outlet port for discharging molten smelt, the smelt spout configured to be in fluid communication with the outlet port so that the molten smelt is able to flow along a flow path of the smelt spout, the cleaning apparatus comprising:

a cleaning tool having a pair of cleaning blades generally aligned with the respective side walls of the smelt spout and extending along the smelt spout side walls in the direction of the flow path, the cleaning blades each having a cleaning edge with a length substantially as long as a portion of the smelt spout which is cleaned by each of the cleaning blades; and an actuating assembly configured to move the cleaning blades along a cleaning path from a retracted position near an upper edge of the side wall to an extended position toward the bottom wall for cleaning the spout, wherein the cleaning blades and the cleaning edges respectively slide along the side walls of the smelt spout from near the upper edge toward the bottom wall to dislodge hardened smelt deposits therefrom as the cleaning blades move from the retracted position to the extended position, and wherein the cleaning blades each have a blade thickness sufficiently small to substantially prevent obstruction of the flow of the molten smelt when the cleaning blades are in the extended position.

2. A cleaning apparatus as in claim 1, wherein the cleaning edges of cleaning blades each extend substantially completely along a length of the smelt spout.

3. A cleaning apparatus as in claim 1, wherein the cleaning blades are each generally planar.

4. A cleaning apparatus as in claim 1, further comprising a support assembly connected to the smelt spout and the cleaning tool and configured to permit the movement of the cleaning blades from the retracted position to the extended position.

5. A cleaning apparatus as in claim 4, the support assembly configured to prevent the cleaning tool from contacting the bottom wall of the smelt spout when the cleaning blades are in the extended position.

6. A cleaning apparatus as in claim 1, wherein the cleaning edges of cleaning blades do not contact the bottom wall of the smelt spout when the cleaning blades are in the extended position.

7. A cleaning apparatus as in claim 4, wherein the support assembly includes hood having a pair of side walls each connected to the smelt spout and each positioned adjacent to one of the cleaning blades, and a pair of connection assemblies each slidably coupling one of the cleaning blades with one of the side walls of the hood.

8. A cleaning apparatus as in claim 7, wherein each of the connection assemblies includes a support rod and a sleeve slidably receiving the support rod to slidably couple the one of the cleaning blades with the one of the side walls of the hood.

9. A cleaning apparatus as in claim 1, the smelt spout including a smelt spout collar positioned within the boiler wall outlet port, the cleaning tool further including a punch to slide along a surface of the smelt spout collar to dislodge hardened smelt deposits therefrom.

10. The cleaning apparatus of claim 9, wherein the punch and the cleaning blades move in unison between the retracted position and the extended position, and wherein the punch slides along the surface of the smelt spout collar to dislodge other hardened smelt deposits therefrom as the punch moves from the retracted position to the extended position.

11. A cleaning apparatus as in claim 1, the smelt spout having a U-shaped cross-section defined by the respective side walls and the bottom wall extending therebetween, the spout side walls positioned a trough width apart from each other, and the cleaning blades each having a blade thickness substantially smaller than the trough width.

12. A cleaning apparatus as in claim 1, wherein the respective side walls of the smelt spout are generally arcuate so that the first and second blades are deflected towards each other when in the extended position.

13. A cleaning apparatus as in claim 1, wherein the cleaning blades each have a blade stiffness sufficient to substantially prevent the cleaning blades from deflecting towards each other when in the extended position.

14. A cleaning apparatus as in claim 1, the actuating assembly configured to move the cleaning blades from the retracted position to the extended position along a cleaning path, wherein the cleaning path and a normal line generally perpendicular to the flow path define a cleaning angle therebetween that is less than or equal to 60 degrees.

15. A cleaning apparatus as in claim 14, wherein the cleaning angle is less than or equal to 45 degrees.

16. A cleaning apparatus as in claim 1, wherein the cleaning blades are positioned above a top surface of the molten smelt when the cleaning blades are in the retracted position and wherein at least a portion of each of the cleaning blades is positioned below the top surface of the molten smelt when the cleaning blades are in the extended position.

17. A cleaning apparatus as in claim 1, wherein the cleaning tool and the actuating assembly are mounted generally above the smelt spout so that a downstream portion of the smelt spout is substantially unobstructed by the cleaning tool and the actuating assembly.

18. A cleaning apparatus for cleaning a smelt spout of a boiler, the smelt spout having respective side walls and a bottom wall extending therebetween, the boiler including a boiler wall defining an outlet port for discharging molten smelt, the smelt spout configured to be in fluid communication with the outlet port so that the molten smelt is able to flow along a flow path of the smelt spout, the cleaning apparatus comprising:

a cleaning tool having a pair of cleaning blades generally aligned with the respective side walls of the smelt spout and extending along the spout side walls in the direction of the flow path, the cleaning blades each having a cleaning edge with a length substantially as long as a portion of the smelt spout which is cleaned by each of the cleaning blades;

a support assembly connected to the smelt spout and the cleaning tool and configured to permit movement of the cleaning blades from a retracted position to an extended position for cleaning the spout;

an actuating assembly connected to the support assembly and the cleaning tool and configured to move the cleaning blades from the retracted position to the extended position along a cleaning path, wherein the cleaning blades respectively slide along the side walls of the smelt spout from near the upper edge toward the bottom wall to dislodge hardened smelt deposits therefrom as the cleaning blades move from the retracted position to the extended position, wherein the cleaning blades each have a blade thickness sufficiently small to substantially prevent obstruction of the flow of the molten smelt when the cleaning blades are in the extended position, and wherein the cleaning path and a normal line generally perpendicular to the flow path define a cleaning angle therebetween that is less than or equal to 60 degrees.

19. A cleaning apparatus as in claim 18, wherein the cleaning angle is less than or equal to 45 degrees.

20. A cleaning apparatus as in claim 18, wherein the cleaning path is generally linear.

21. A cleaning apparatus as in claim 18, wherein the cleaning path is generally arcuate.

22. A cleaning apparatus as in claim 18, wherein the cleaning edges of cleaning blades each extend substantially completely along a length of the smelt spout.

23. A cleaning apparatus as in claim 18, wherein the support assembly includes hood having a pair of side walls each connected to the smelt spout and each positioned adjacent to one of the cleaning blades and a pair of connection assemblies each slidably coupling one of the cleaning blades with one of the side walls of the hood.

24. A cleaning apparatus as in claim 23, wherein each of the connection assemblies includes a support rod and a sleeve slidably receiving the support rod to slidably couple the one of the cleaning blades with the one of the side walls of the hood.

25. A cleaning apparatus as in claim 18, the smelt spout including a smelt spout collar positioned within the boiler wall outlet port, the cleaning tool further including a punch configured to slide along a surface of the smelt spout collar to dislodge hardened smelt deposits therefrom.

26. A cleaning apparatus as in claim 18, the smelt spout having a trough including a U-shaped cross-section defined by the respective side walls of the smelt spout and the bottom wall extending therebetween, the respective spout side walls positioned a trough width apart from each other, and the cleaning blades each having a blade thickness substantially smaller than the trough width.

27. A cleaning apparatus as in claim 26, wherein the actuating assembly is configured to move the cleaning blades from the retracted position to the extended position along the cleaning path towards the bottom wall of the trough so that the cleaning blades drive the hardened smelt deposits toward the bottom of the trough and into the molten smelt.

28. A cleaning apparatus as in claim 18, wherein the cleaning blades are positioned above a top surface of the molten smelt when the cleaning blades are in the retracted position and wherein at least a portion of each of the cleaning blades is positioned below the top surface of the molten smelt when the cleaning blades are in the extended position.

29. A smelt discharge assembly for facilitating the removal of molten smelt from a boiler, the smelt discharge assembly comprising:

a smelt spout in fluid communication with an outlet port of a boiler so that the molten smelt from the boiler is able to flow along a flow path defined by the smelt spout;

a cleaning tool having a pair of cleaning blades generally aligned with respective side walls of the smelt spout and extending along the side walls in the direction of the flow path, the cleaning blades each having a cleaning edge with a length substantially as long as a portion of the smelt spout which is cleaned by each of the cleaning blades;

a support assembly connected to the smelt spout and the cleaning tool and configured to permit the movement of the cleaning blades from a retracted position to an extended position for cleaning the spout; and an actuating assembly configured to move the cleaning blades from the retracted position to the extended position along a cleaning path, wherein the edges of the cleaning blades respectively slide along the side walls from near the upper edge toward the bottom wall when the cleaning blades are moved toward the extended position, wherein the cleaning blades each have a blade thickness sufficiently small to substantially prevent obstruction of the flow of the molten smelt when the cleaning blades are in the second position, and wherein the cleaning path is generally nonparallel to the flow path.

* * * * *